US010697110B2

(12) United States Patent
Shin et al.

(10) Patent No.: US 10,697,110 B2
(45) Date of Patent: Jun. 30, 2020

(54) DUAL DRYING APPARATUS

(71) Applicant: Samsung Electronics Co., Ltd., Suwon-si (KR)

(72) Inventors: Nu-ri Shin, Seongnam-si (KR); Zoo-hyeong Kim, Suwon-si (KR); Yeong-il Ju, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 99 days.

(21) Appl. No.: 15/860,160

(22) Filed: Jan. 2, 2018

(65) Prior Publication Data

US 2018/0187365 A1 Jul. 5, 2018

(30) Foreign Application Priority Data

Jan. 2, 2017 (KR) ..... 10-2017-0000418

(51) Int. Cl.
*F26B 3/34* (2006.01)
*D06F 58/10* (2006.01)

(52) U.S. Cl.
CPC ..... *D06F 58/10* (2013.01)

(58) Field of Classification Search
CPC ..... D06F 58/00; D06F 58/10; D06F 58/20
USPC ..... 34/264, 260, 261, 418, 114, 121
See application file for complete search history.

(56) References Cited

U.S. PATENT DOCUMENTS 7,913,419 B2 * 3/2011 Tomasi ..... D06F 29/00 211/85.3
2004/0194339 A1 10/2004 Johnson et al.
2006/0137208 A1 6/2006 Lee et al.
2008/0053166 A1 * 3/2008 Lim ..... D06F 29/005 68/5 C
2009/0025432 A1 1/2009 Kim et al.
2009/0145176 A1 6/2009 Kim et al.
2015/0145388 A1 5/2015 Jung et al.
2015/0259844 A1 * 9/2015 Doyle ..... D06F 58/02 68/17 R

FOREIGN PATENT DOCUMENTS

| | | |
|---|---|---|
| CN | 204370179 | 6/2015 |
| CN | 205242103 | 5/2016 |
| CN | 205669138 | 11/2016 |
| EP | 1710341 | 10/2006 |
| EP | 1895041 | 3/2008 |
| EP | 2113596 | 11/2009 |
| JP | 2006-239051 | 9/2006 |
| JP | 2007-117228 | 5/2007 |
| KR | 10-2006-0060212 | 6/2006 |

(Continued)

OTHER PUBLICATIONS

International Search Report and Written Opinion of the International Searching Authority dated May 18, 2018 in International Patent Application No. PCT/KR2017/015229.

(Continued)

*Primary Examiner* — John P McCormack
(74) *Attorney, Agent, or Firm* — Staas & Halsey LLP

(57) ABSTRACT

A dual drying apparatus having respective dryers arranged up and down, which includes a lower dryer, and an upper dryer arranged on an upper side of the lower dryer, where the dual drying apparatus includes a partition configured to partition an interior of the lower dryer from an interior of the upper dryer.

14 Claims, 10 Drawing Sheets

(56) References Cited

FOREIGN PATENT DOCUMENTS

| | | |
|---|---|---|
| KR | 10-2006-0064184 | 6/2006 |
| KR | 10-2008-0021948 | 3/2008 |
| KR | 10-2011-0035028 | 4/2011 |
| KR | 10-1276818 | 6/2013 |

OTHER PUBLICATIONS

Chinese Office Action dated Nov. 5, 2019 in Chinese Patent Application No. 201711404533.6.
Extended European Search Report dated Dec. 6, 2019 in European Patent Application No. 17886731.3.
Chinese Office Action dated Apr. 9, 2020 in Chinese Patent Application No. 201711404533.6.

* cited by examiner

DUAL DRYING APPARATUS

CROSS-REFERENCE TO RELATED APPLICATIONS

This application claims priority from Korean Patent Application No. 10-2017-0000418 filed on Jan. 2, 2017 in the Korean Intellectual Property Office, the disclosure of which is incorporated herein by reference in its entirety.

BACKGROUND OF THE INVENTION

Field of the Invention

The present disclosure relates to a dual drying apparatus, and more particularly, to a dual drying apparatus, which enables dryers arranged up and down to independently perform drying of clothes or the like.

Description of the Related Art

In general, a clothes dryer for drying clothes or the like may be a single dryer that can dry clothes by applying hot air thereto while tumbling the wet clothes using one rotary drum.

On the other hand, a dual clothes dryer in the related art may be implemented by arranging the above-described single dryers up and down. In this case, since the respective dryers located up and down have the same height, the height of the dryer set is increased, and this may cause the installation space of the dual clothes dryer to be restricted to lower usability of consumers.

In order to solve the problem caused by the height of the dual clothes dryer as described above, the dual clothes dryer may have a structure in which upper and lower dryers are arranged up and down within one cabinet. In this case, interiors of the lower and upper dryers communicate with each other, and if fire occurs in the lower dryer, flames may be easily transferred up to the upper dryer.

Further, water collected from wet clothes during a drying operation of the upper dryer may be dropped into the lower dryer. In this case, if the water is dropped on an electrical system of the lower dryer, a short circuit may occur to cause a malfunction of the dryer.

Further, if a control panel portion corresponding to the respective dryers is arranged between the lower and upper dryers in the dual clothes dryer in the related art, a user should bend the body to use the control panel portion, and thus usability may deteriorate.

SUMMARY OF THE INVENTION

Exemplary embodiments of the present disclosure overcome the above disadvantages and other disadvantages not described above, and provide a dual drying apparatus having a partition member, which can basically block transfer of a fire that may occur in a lower dryer to an upper dryer, and does not interfere with an arrangement of structures provided in the lower and upper dryers.

Further, exemplary embodiments of the present disclosure provide a dual drying apparatus, in which a control panel portion for operating lower and upper dryers is arranged in a place where a user can conveniently use the control panel portion.

According to an aspect of the present disclosure, a dual drying apparatus includes a lower dryer; an upper dryer arranged on an upper side of the lower dryer, a partition member configured to partition an interior of the lower dryer from an interior of the upper dryer, wherein a part of the partition member is shaped to be disposed along an exterior portion of a rotary drum in the lower dryer.

The part of the partition member may convexly project toward the upper dryer.

The partition member may be made of an incombustible material or a flame retardant material.

A front cabinet of the lower dryer may have an upper end that is located higher than the partition member.

The upper dryer may include a control panel portion arranged on an upper side of the front cabinet of the lower dryer.

The upper dryer may include a drying chamber configured to accommodate an object to be dried; a frame configured to support the drying chamber; and a reinforcement bracket configured to be coupled to a front of the frame.

The frame may include left and right wall bodies configured to support left and right sides of the drying chamber, respectively; and first and second connection portions configured to connect front portions and rear portions of the left and right wall bodies, respectively, wherein both sides of the reinforcement bracket may be screw-fastened to front ends of the left and right wall bodies, respectively.

A coupling location of the upper dryer may be guided by a coupling location guide portion when the upper dryer is coupled to the lower dryer.

The coupling location guide portion may include a plurality of setting projections formed on any one of the lower dryer and the upper dryer; and a plurality of insertion holes formed on another one of the lower dryer and the upper dryer so that the plurality of setting projections are respectively inserted therein.

The plurality of setting projections may be arranged at predetermined intervals along both end portions of any one of the lower dryer and the upper dryer, and the plurality of insertion holes may be arranged at predetermined intervals along both end portions of the other of the lower dryer and the upper dryer.

The lower dryer and the upper dryer may be fixed to each other through screw fastening on front and rear surfaces thereof.

Additional and/or other aspects and advantages of the disclosure will be set forth in part in the description which follows and, in part, will be obvious from the description, or may be learned by practice of the disclosure.

BRIEF DESCRIPTION OF THE DRAWING FIGURES

The above and/or other aspects of the present disclosure will be more apparent by describing certain exemplary embodiments of the present disclosure with reference to the accompanying drawings, in which.

DETAILED DESCRIPTION OF THE EXEMPLARY EMBODIMENTS

For full understanding of the configuration and effects of the present disclosure, exemplary embodiments of the present disclosure will be described with reference to the accompanying drawings. However, the present disclosure is not limited to embodiments disclosed hereinafter, but may be implemented in several types, and various modifications may be made. The following description with reference to the accompanying drawings is provided to assist those of ordinary skill in the art to comprehensively understand the technical features of the present disclosure. In order to help understanding of the present disclosure, sizes of some constituent elements illustrated in the accompanying drawings may be exaggerated or reduced for clarity in explanation.

The terms "first, second, and so forth" are used to describe various elements regardless of their order or importance and to discriminate one element from other elements, but are not limited to the corresponding elements. For example, a first element and a second element may indicate different elements regardless of their order or importance. For example, without departing from the scope of the present disclosure, the first element may be called the second element, and the second element may be called the first element in a similar manner.

Unless differently defined, the terms used in embodiments of the present disclosure may be analyzed as meanings generally known to those of ordinary skill in the art to which the present disclosure pertains.

Hereinafter, a dual drying apparatus according to an embodiment of the present disclosure will be described with reference to the accompanying drawings.

Figure 1:
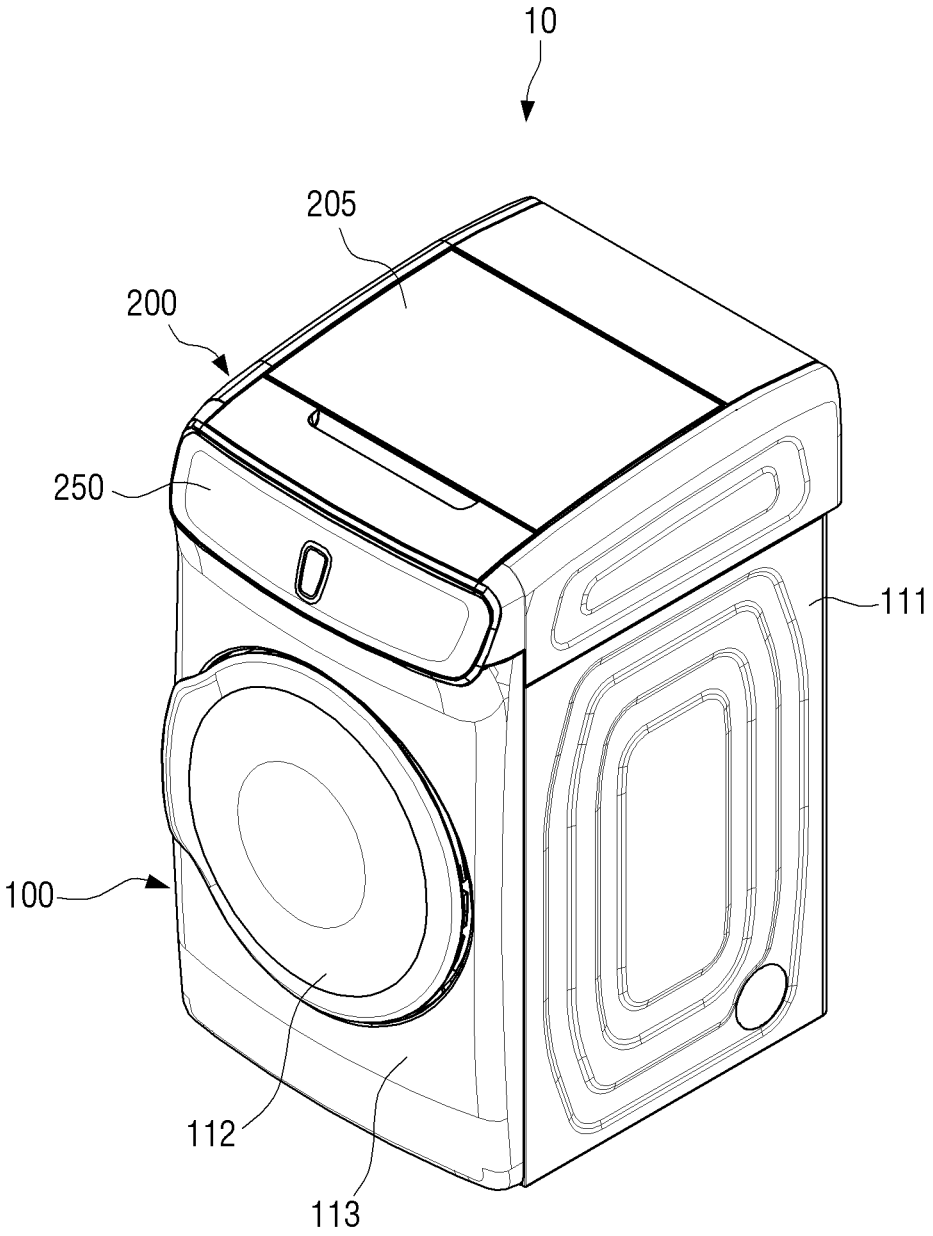
FIG. 1 is a perspective view illustrating a dual drying apparatus according to an embodiment of the present disclosure.
Figure 2:
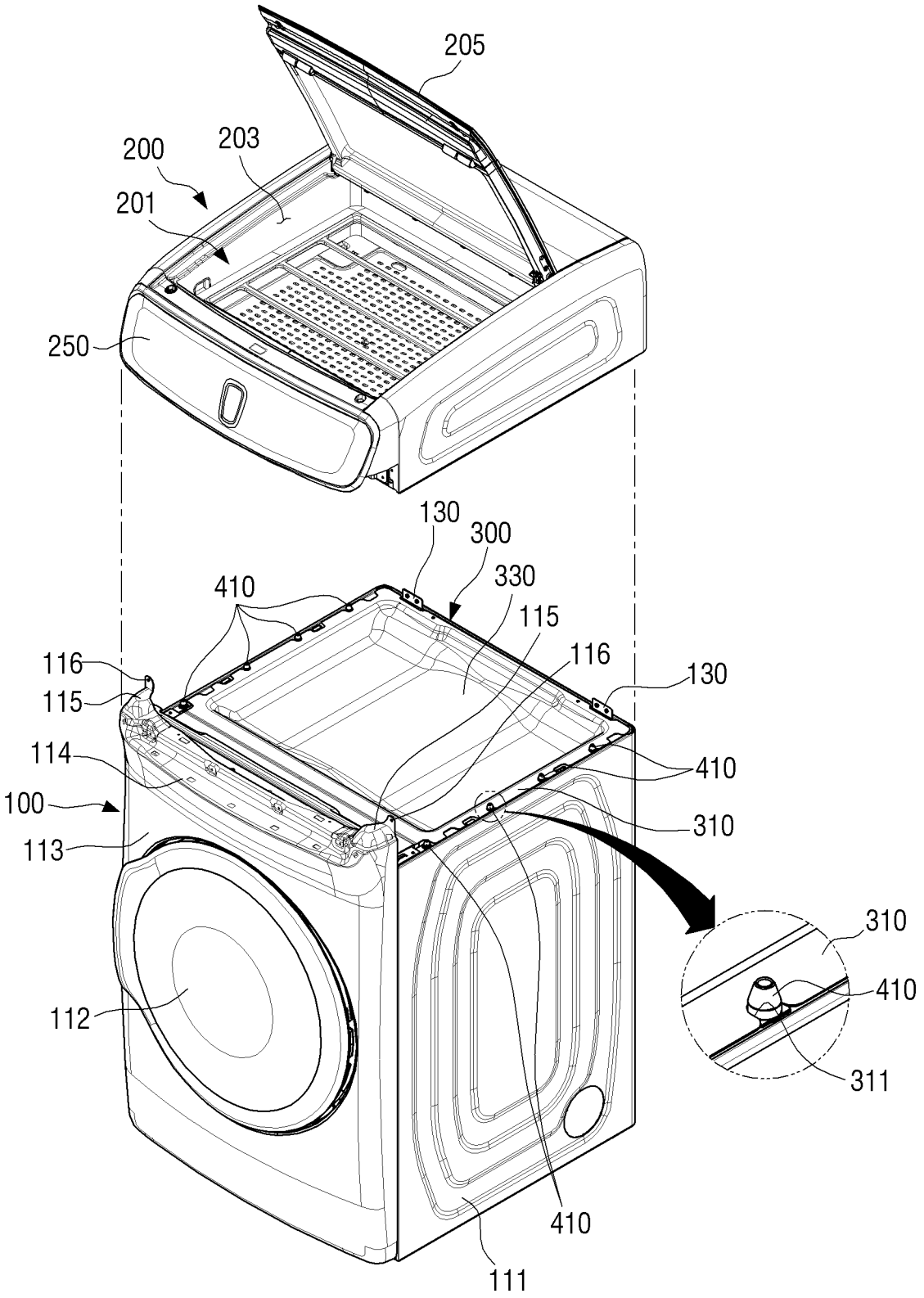
FIG. 2 is an exploded perspective view illustrating a state where a lower dryer and an upper dryer are separated from each other.

FIG. 1 is a perspective view illustrating a dual drying apparatus according to an embodiment of the present disclosure, and FIG. 2 is an exploded perspective view illustrating a state where a lower dryer and an upper dryer are separated from each other.

Referring to FIG. 1, a dual drying apparatus 10 includes a lower dryer 100, and an upper dryer 200 arranged on an upper side of the lower dryer 100.

The lower dryer 100 may include a main cabinet 111 configured to form an external appearance of left, right, and rear sides of the lower dryer 100, and a front cabinet 113 configured to form an external appearance of a front side of the lower dryer 100.

In this case, as shown in FIG. 2, an upper end 114 of the front cabinet 113 may be formed higher than the location of a partition member 300 to be described later. Accordingly, a control panel portion 250 of the upper dryer 200 located on an upper side of the upper end 114 of the front cabinet 113 is located on an upper side of the partition member 300.

As described above, since the control panel portion 250 is arranged at the highest location on the front surface of the dual drying apparatus 10, a user can operate the control panel portion 250 without bending the body, and thus use convenience can be increased. Further, the control panel portion 250 includes a circuit board for controlling both the lower dryer 100 and the upper dryer 200, and thus the user can operate the lower dryer and the upper dryer through the one control panel portion 250 in a comfortable posture.

A rotary drum 140 (see FIG. 3) is arranged inside the lower dryer 100, and a door 112 for opening/closing an interior of the rotary drum 140 is hinge-connected to the front cabinet 113. The rotary drum 140 has a space provided therein to accommodate objects to be dried, that is, clothes. Wet clothes accommodated in the space of the rotary drum 140 may be dried by tumbling and hot air.

Referring to FIG. 2, the upper dryer 200 is provided with a drying chamber 201 having a clothes accommodation space 203 therein, and a door 205 for opening/closing the drying chamber 201 is hinge-connected to the upper side of the upper dryer 200. The control panel portion 250 for controlling the lower dryer 100 and the upper dryer 200 is coupled to the front of the upper dryer 200.

As illustrated in FIG. 2, the upper dryer 200 may be separably coupled to an upper portion of the lower dryer 100. In this case, an interior of the lower dryer 100 and an interior of the upper dryer 200 may be partitioned by the partition member 300 arranged between the lower dryer 100 and the upper dryer 200.

Since the interior of the lower dryer 100 and the interior of the upper dryer 200 are partitioned by the partition member 300, polluted wet air and lint that may be generated during drying in the lower dryer 100 may not exert an influence on the operation of the upper dryer 200, and thus the overall performance of the dual drying apparatus 10 can be improved.

The partition member 300 may prevent water collected from the wet clothes during drying in the upper dryer 200 from being dropped to flow into the lower dryer 100. Accordingly, a short circuit can be prevented from occurring due to the water dropping from the upper dryer 200 onto various kinds of electronic components for driving the lower dryer 100.

On the other hand, since a heater for supplying hot air and a motor for rotating the rotary drum are used together in the clothes dryer, there is a possibility that the motor is affected by the high-temperature hot air to cause the occurrence of a fire. If a fire occurs in the lower dryer 100, the partition member 300 can block spreading of the fire to the upper dryer 200. In this case, the partition member 300 may be made of an incombustible material or a flame retardant material having high refractory properties.

Further, in the case of manufacturing the partition member 300 through injection molding, various designs can be applied in consideration of structures in the dual drying apparatus 10.

Figure 3:
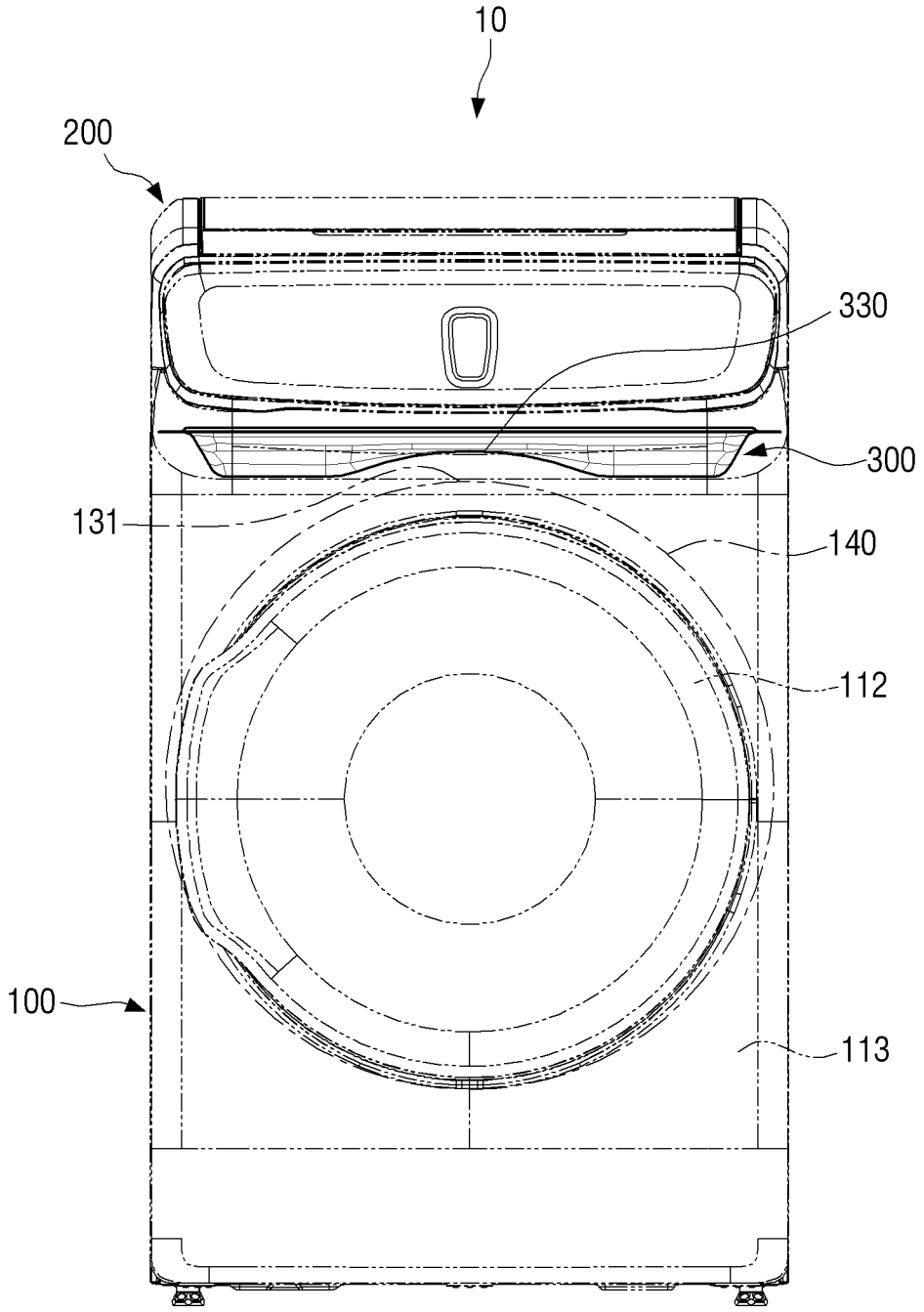
FIG. 3 is a schematic view illustrating a rotary drum arranged inside a lower dryer and a curved partition corresponding to the shape of the rotary drum.

FIG. 3 is a schematic view illustrating a rotary drum arranged inside a lower dryer and a curved partition corresponding to the shape of the rotary drum.

A part of the partition member 300 may be formed corresponding to an external appearance of the rotary drum 140 arranged inside the lower dryer 100. That is, as illustrated in FIG. 3, if an upper portion 131 of the rotary drum 140 is formed to have a specific curvature, a center portion 330 of the partition member 300 corresponding to the upper portion 131 of the rotary drum 140 may be formed to have the same or similar curvature as or to the curvature of the upper portion of the rotary drum 140. In this case, the center portion 330 of the partition member 300 may be formed to be convexly curved toward the upper dryer 200.

On the other hand, as illustrated in FIG. 2, the lower dryer 100 and the upper dryer 200 may be separably coupled to each other. For this, the lower dryer 100 and the upper dryer 200 may have a coupling structure for separably coupling them to each other.

The coupling between the lower dryer 100 and the upper dryer 200 is performed as follows. First, since the upper dryer 200 has a heavy weight, it is not easy to set the coupling location as moving the location of the upper dryer 200 little by little in a state where the upper dryer 200 is put on the upper portion of the lower dryer 100. Accordingly, in order to easily set the coupling location between the lower dryer 100 and the upper dryer 200, the coupling location is set through a plurality of setting projections 410 to be described later as the upper dryer 200 is being put on the upper portion of the lower dryer 100.

Then, both sides of front surfaces and both sides of rear surfaces of the lower dryer 100 and the upper dryer 200 are screw-fastened to complete the coupling between the lower dryer 100 and the upper dryer 200.

Hereinafter, the above-described coupling structure will be described in detail with reference to the drawings. First, a coupling location guide portion for setting the upper dryer 200 to the coupling location will be described.

Figure 4:
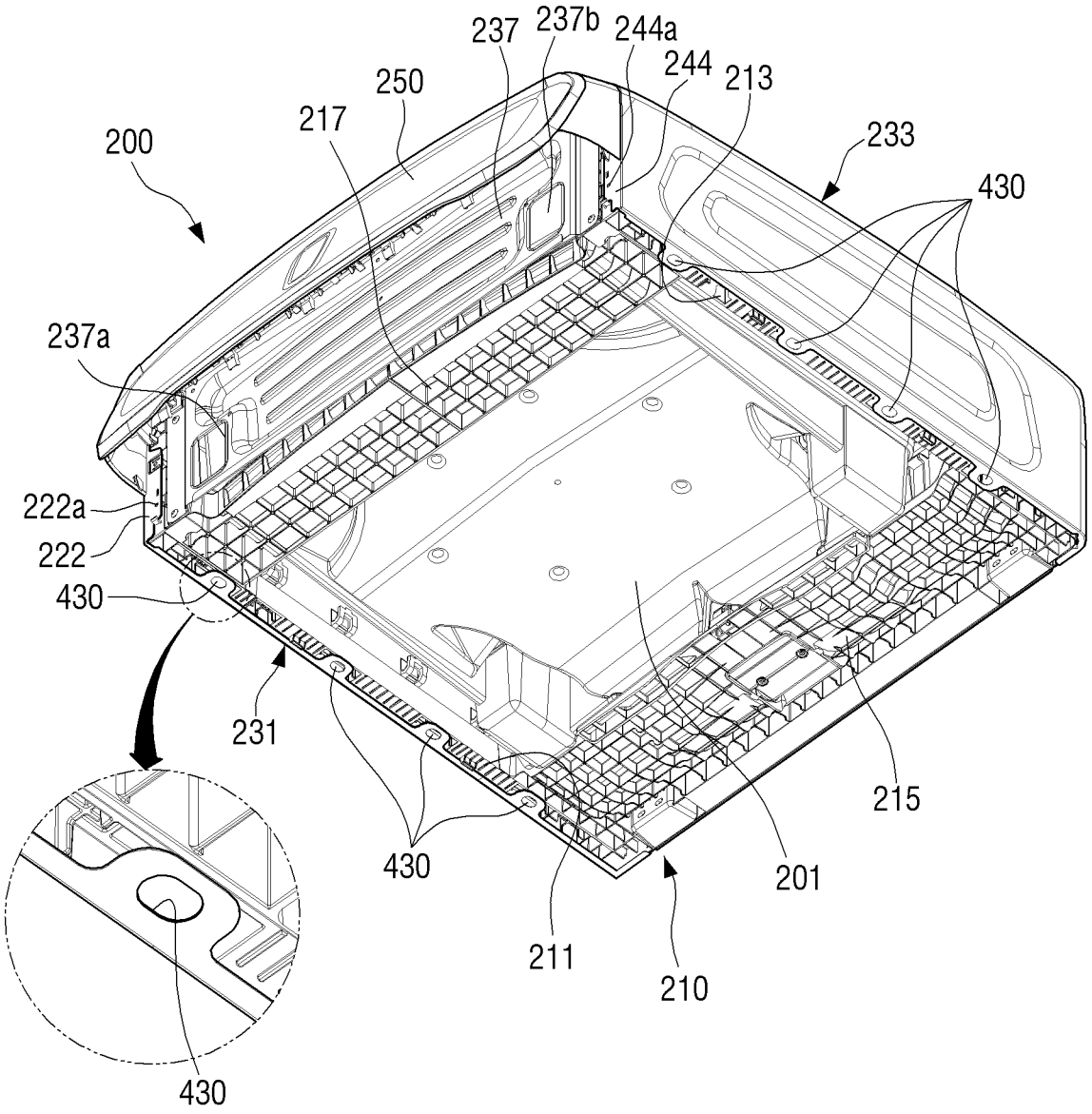
FIG. 4 is a perspective view illustrating a bottom surface of an upper dryer.
Figure 5:
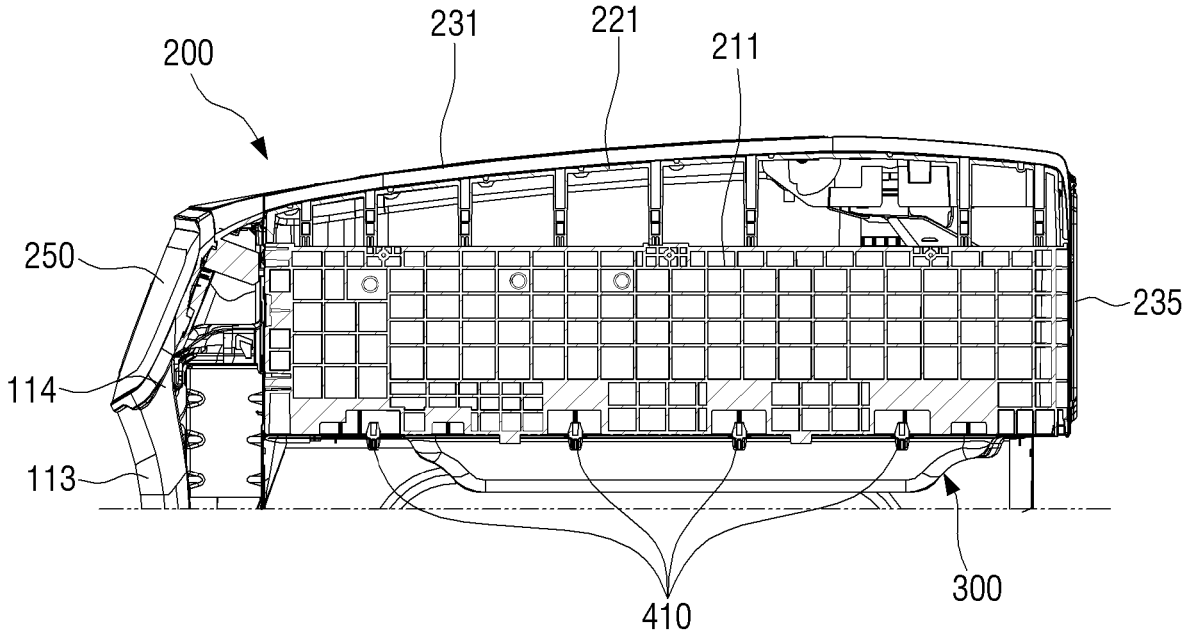
FIG. 5 is a cross-sectional view illustrating a state where an upper dryer is seated on an upper portion of a lower dryer through being guided by a plurality of setting projections.

FIG. 4 is a perspective view illustrating a bottom surface of an upper dryer, and FIG. 5 is a cross-sectional view illustrating a state where an upper dryer is seated on an upper portion of a lower dryer through being guided by a plurality of setting projections.

The coupling location guide portion may include a plurality of setting projections 410 (see FIG. 2) provided on the lower dryer 100, and a plurality of insertion holes 430 (see FIG. 4) provided on the upper dryer 200.

The fastening hole 222*a* may be formed on the fastening rib 222 which is formed to be bent on a front end of the left cover 231. And the fastening hole 244*a* may be formed on the fastening rib 244 which is formed to be bent on a front end of the right cover 233.

As illustrated in FIG. 2, the plurality of setting projections 410 are arranged at predetermined intervals along both end portions of the upper surface of the lower dryer 100. The plurality of setting projections 410 may be roughly in a cone shape so that they can be smoothly inserted into the plurality of insertion holes 430.

The plurality of setting projections 410 may be manufactured as separate components and may be separably mounted on the main cabinet 111 of the lower dryer 100. However, the plurality of setting projections 410 are not limited thereto, but it is also possible that they are integrally formed with the main cabinet 111 or integrally formed with a border 310 of the partition member 300.

On the other hand, as illustrated in FIG. 2, on the partition member 300, a through groove 311 that is penetrated by the plurality of setting projections 410 may be formed so as not to interfere with the plurality of setting projections 410.

As illustrated in FIG. 4, the plurality of insertion holes 430 may be formed at intervals along both end portions of a bottom surface of the upper dryer 200. In this case, an interval between the plurality of insertion holes 430 arranged in a line is equal to an interval between the plurality of setting projections 410.

The plurality of insertion holes 430 may be formed along lower ends of a left cover 231 and a right cover 233 of the upper dryer 200 to be described later. However, the location where the plurality of insertion holes 430 are formed is not limited thereto, but the plurality of insertion holes 430 may be formed along lower ends of a left wall body 211 and a right wall body 213 of a frame 210.

It has been described that the plurality of setting projections 410 are provided on the lower dryer 100 and the plurality of insertion holes 430 are provided on the upper dryer 200, but are not limited thereto. It is also possible that the plurality of setting projections 410 are provided on the upper dryer 200 and the plurality of insertion holes 430 are provided on the lower dryer 100.

As described above, when the upper dryer 200 is put on the upper portion of the lower dryer 100 in order to couple the upper dryer 200 to the lower dryer 100, as illustrated in FIG. 5, the plurality of setting projections 410 of the lower dryer are inserted into the plurality of insertion holes 430 of the upper dryer 200, and thus the coupling location between the lower dryer 100 and the upper dryer 200 can be easily set.

The coupling structure for fixing the lower dryer 100 and the upper dryer 200 to each other after setting the upper dryer 200 to the coupling location through the coupling location guide portion composed of the plurality of setting projections 410 and the plurality of insertion holes 430 will be described hereinafter.

Figure 6:
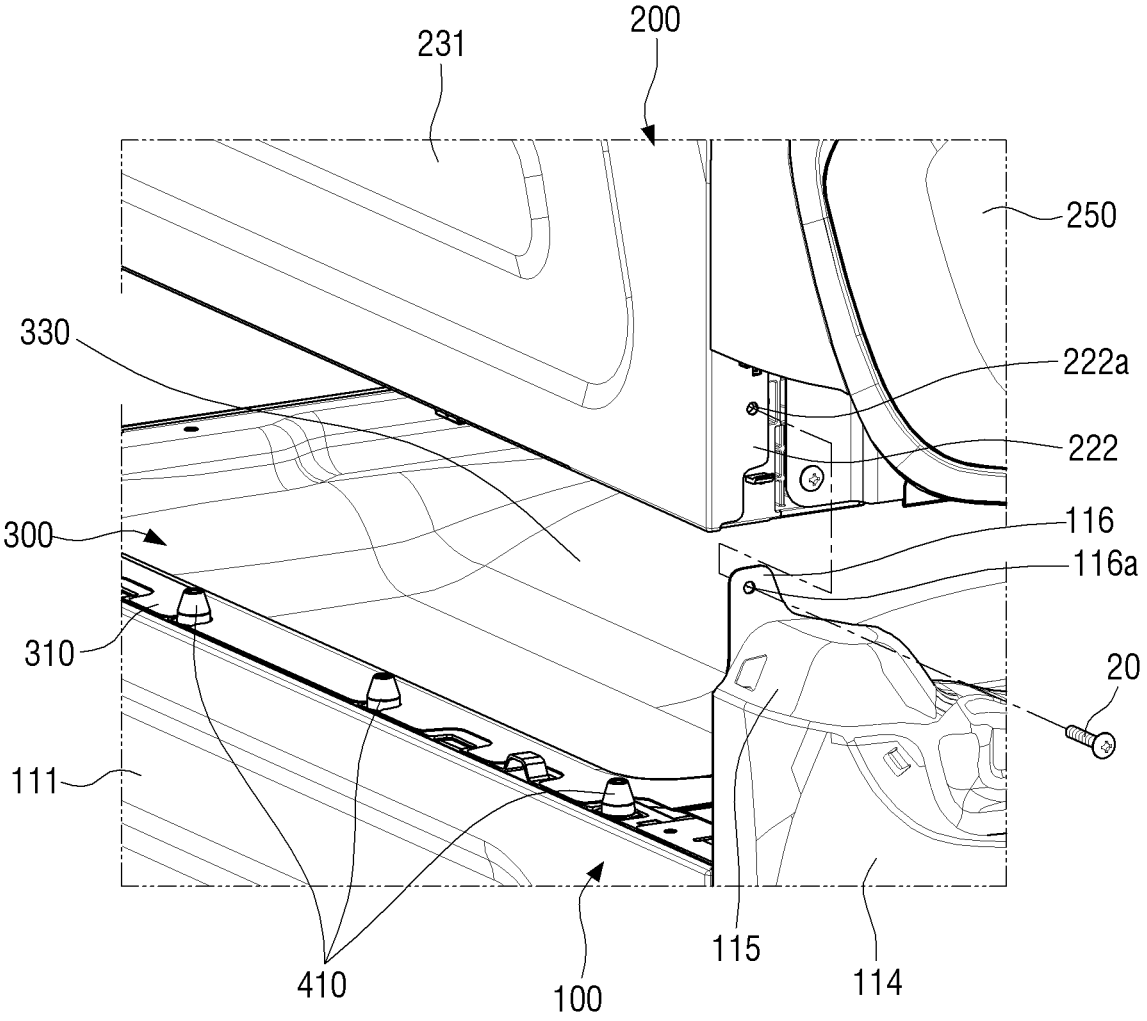
FIG. 6 is an exploded perspective view illustrating a front fastening structure of a lower dryer and an upper dryer.
Figure 7:
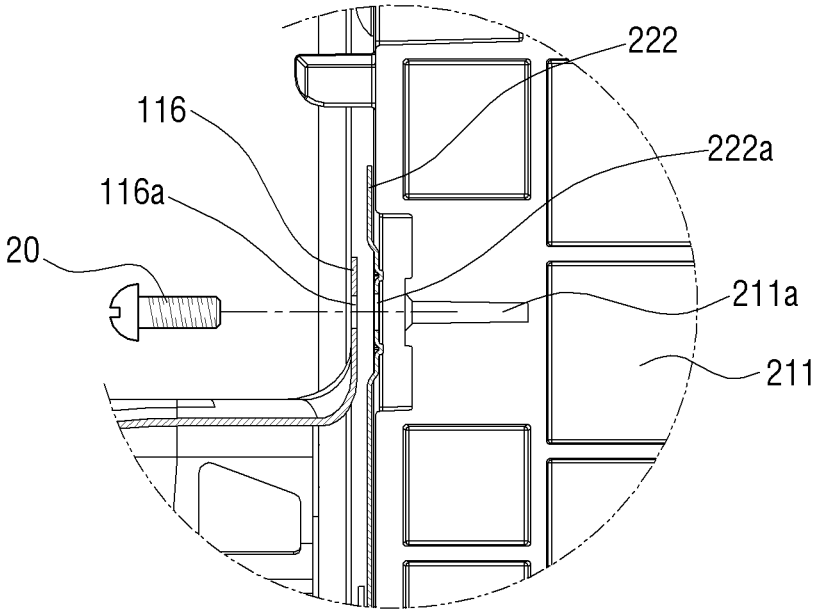
FIG. 7 is a combined cross-sectional view illustrating a front fastening structure of a lower dryer and an upper dryer.

FIG. 6 is an exploded perspective view illustrating a front fastening structure of a lower dryer and an upper dryer, and FIG. 7 is a combined cross-sectional view illustrating a front fastening structure of a lower dryer and an upper dryer.

For a front fastening structure, as illustrated in FIG. 2, front mounting ribs 116 are projected upward from both sides of the upper end 114 of the front cabinet 113 of the lower dryer 100. A fastening hole 116*a* for fastening a screw 20 is formed on the front mounting rib 116. The front mounting rib 116 may be formed on an upper side of a fixing projection portion 115 for fixing the control panel portion 250 of the upper dryer 200.

Further, for the front fastening structure, a fastening hole 222*a*, 244*a* penetrated by the screw 20 that has passed through the fastening hole 116*a* of the front mounting rib 116 is formed on the left cover 231 and the right cover 233 of the upper dryer 200. The fastening hole 222*a* may be formed on the fastening rib 222 which is formed to be bent on a front end of the left cover 231. Further, a fastening hole 211*a* (see FIG. 7) for fastening the screw 20 is formed even at each front end of the left wall body 211 and the right wall body 213 of the frame. In this case, the respective fastening holes 211*a* are concentrically arranged on the fastening holes 222*a* formed on the left cover 231 and the right cover 233.

On the other hand, if the upper dryer 200 is set to the coupling location through the coupling location guide portion, as illustrated in FIG. 7, the fastening holes 116*a* of the front mounting ribs 116 may be roughly concentrically arranged on the fastening holes 233*a* of the left cover 231 and the right cover 233. In this state, the screws 20 are fastened through the fastening holes 116*a* of the respective front mounting ribs 116, the fastening holes 233*a* of the left cover 231 and the right cover 233, and the fastening holes 211*a* of the left wall body 211 and the right wall body 213 of the frame in due order.

Accordingly, the front surface of the lower dryer 100 and the front surface of the upper dryer 200 may be firmly fixed to each other through the screw fastening.

Figure 8:
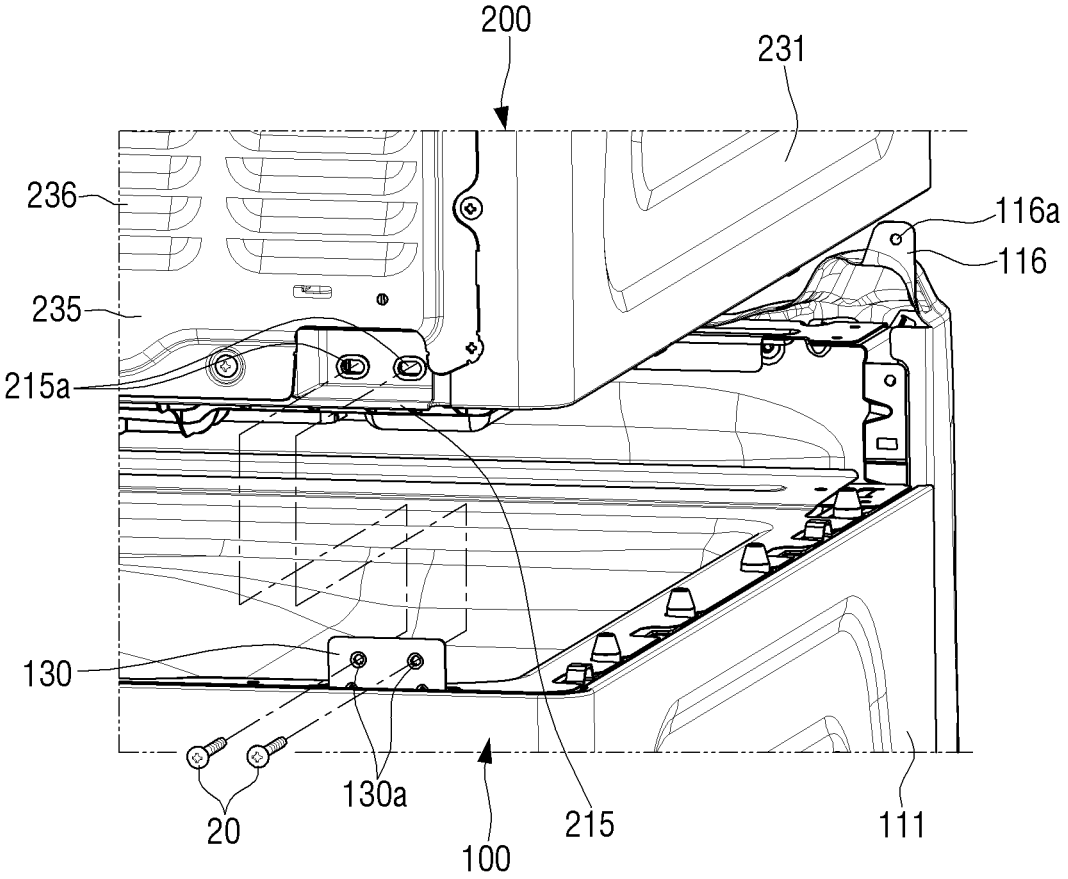
FIG. 8 is an exploded perspective view illustrating a rear fastening structure of a lower dryer and an upper dryer.
Figure 9:
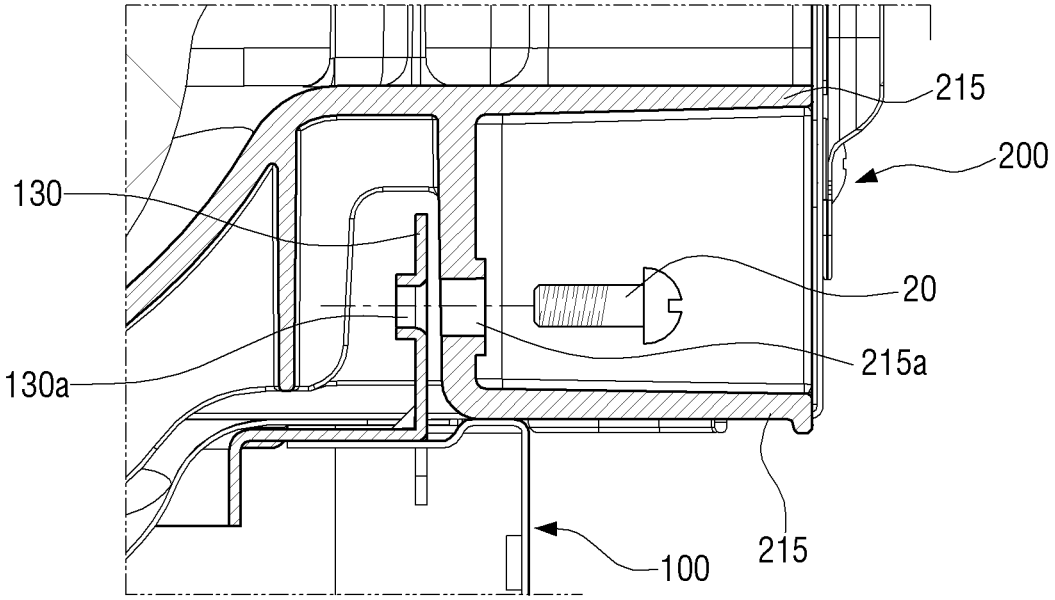
FIG. 9 is a combined cross-sectional view illustrating a rear fastening structure of a lower dryer and an upper dryer.

FIG. 8 is an exploded perspective view illustrating a rear fastening structure of a lower dryer and an upper dryer, and FIG. 9 is a combined cross-sectional view illustrating a rear fastening structure of a lower dryer and an upper dryer.

For a rear fastening structure, as illustrated in FIG. 2, rear mounting ribs 130 are arranged on both sides of the rear end of the upper surface of the lower dryer 100. A plurality of fastening holes 1130*a* (see FIG. 8) penetrated by the screws 20 are on the rear mounting ribs 130.

The respective rear mounting ribs 130 may be formed of separate components or may be integrally formed with the main cabinet 111.

Further, for the rear fastening structure, a plurality of fastening holes 215*a* (see FIG. 8) for fastening the screws 20 are formed on both sides of the lower end of the rear surface of the upper dryer 200. Specifically, the plurality of fastening holes 215*a* are penetratingly formed on a first connection portion 215 of the frame 210.

On the other hand, if the upper dryer 200 is set to the coupling location through the coupling location guide portion, as illustrated in FIG. 9, the plurality of fastening holes 215*a* of the first connection portion 215 of the frame 210 may be roughly concentrically arranged on the fastening holes 130*a* of the rear mounting ribs 130. In this state, the screws 20 are fastened through the plurality of fastening holes 215*a* of the connection portion 215 of the frame 210 and the fastening holes 130*a* of the rear mounting ribs 130 in due order.

Accordingly, the front surface of the lower dryer 100 and the rear surface of the upper dryer 200 can be firmly fixed to each other through the screw fastening.

It has been described that the lower dryer 100 and the upper dryer 200 are separably coupled to each other. However, the present disclosure is not limited thereto, but the lower dryer 100 and the upper dryer 200 may be integrally formed. In this case, external appearances of the lower dryer 100 and the upper dryer 200 may be formed by the same cabinet (not illustrated).

Figure 10:
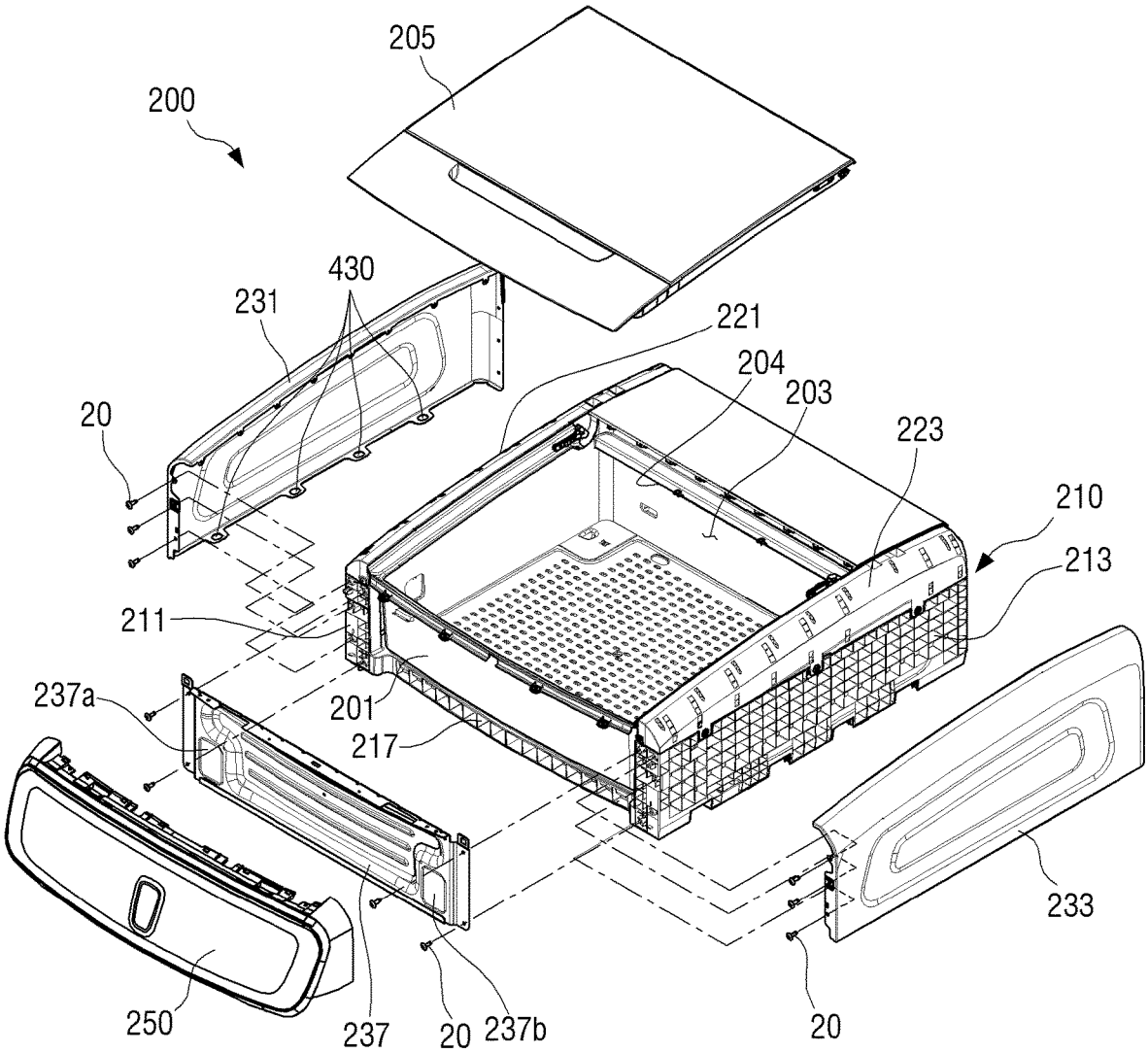
FIG. 10 is an exploded perspective view illustrating an upper dryer.

Hereinafter, the structure of the upper dryer 200 will be described in detail with reference to the drawing. FIG. 10 is an exploded perspective view illustrating the upper dryer.

Referring to FIG. 10, the upper dryer 200 includes a drying chamber 201, a door 205 for opening/closing the drying chamber 201, a frame 210 configured to support the drying chamber 201, a plurality of covers 231, 233, and 235 configured to cover the left, right, and rear surfaces of the frame, a reinforcement frame 237 fixed to the front surface of the frame, and a control panel unit 250 configured to control the lower dryer 100 and the upper dryer 200.

A clothes accommodation space 203 for accommodating therein wet clothes is provided inside the drying chamber 201. Hot air is supplied to the clothes accommodation space 203 by a heater (not illustrated) and a blower fan (not illustrated) provided inside the rear of the upper dryer 200. The hot air supplied to the clothes accommodation space 203 dries the wet clothes, and then discharges the dried clothes out of the upper dryer through a discharge port 204 arranged in the clothes accommodation space 203.

The frame 210 supports the drying chamber 201, and forms the frame of the upper dryer 200. The frame 210 includes a left wall body 211 and a right wall body 213 configured to support the left and right sides of the drying chamber 201. Further, as illustrated in FIG. 4, the frame 210 includes a first connection portion 215 configured to connect rear ends of the left wall body 211 and the right wall body 213 and a second connection portion 217 configured to connect front ends of the left wall body 211 and the right wall body 213.

The frame 210 may be formed of resin through injection molding so as to reduce its weight and to maintain specific rigidity.

To upper portions of the left wall body 211 and the right wall body 213, a left reinforcement frame 221 and a right reinforcement frame 223 may be respectively coupled through screw fastening.

The left and right reinforcement frames 221 and 223 may be hinge-connected to the rear end of the door 205. The door 205 is hinge-connected to the left and right reinforcement frames 221 and 223 so as to open/close the clothes accommodation space 203 of the drying chamber 201.

Left and right covers 231 and 233 are coupled to outer surfaces of the left and right wall bodies 211 and 213. The left and right covers 231 and 233 may cover the left and right reinforcement frames 221 and 223. Front and rear ends of the left and right covers 231 and 233 may be respectively coupled to the front and rear ends of the left and right wall bodies 211 and 213 through a plurality of screws 20.

Since the second connection portion 217 of the frame 210 connects the lower portions of the front ends of the left and right wall bodies 211 and 213, it has a structure having a relatively low rigidity as compared with the left, right, and rear sides of the frame 210. Accordingly, in order to reinforce the front of the frame, a reinforcement bracket 237 may be coupled to the front surface of the frame 210.

Specifically, both ends of the reinforcement bracket 237 are respectively fastened to the front ends of the left and right wall bodies 211 and 213 through the screws 20. Since the reinforcement bracket 237 connects the front ends of the left and right wall bodies 211 and 213, rigidity against the front surface of the frame 210 can be heightened.

A first pass hole 237*a* for passing a wire connected to the control panel portion 250 may be formed on the left side of the reinforcement bracket 237, and a second pass hole 237*b* for passing a wire drawn from the control panel portion 250 may be formed on the right side of the reinforcement bracket 237. It is preferable that the first and second pass holes 237*a* and 237*b* are formed with a size enough to exert no influence on the rigidity of the reinforcement bracket 237.

The control panel portion 250 is mounted on the front surface of the frame 210 in a state where the reinforcement bracket 237 is coupled to the frame 210.

As described above, the control panel portion 250 includes a circuit board together with the lower dryer 100 and the upper dryer 200. Further, the control panel portion 250 is arranged at the highest location on the front surface of the dual drying apparatus 10, and thus use convenience can be increased when the user operates the control panel portion 250.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A dual drying apparatus comprising:

a lower dryer including a rotary drum disposed therein;

an upper dryer including a bottom surface shaped to correspond to an upper surface of the lower dryer such that the upper dryer is coupleable to the lower dryer; and a partition member configured to partition an interior of the lower dryer from an interior of the upper dryer, and wherein a part of the partition member is shaped to be disposed along an exterior portion of the rotary drum in the lower dryer.

2. The dual drying apparatus as claimed in claim 1, wherein the part of the partition member convexly projects toward the upper dryer.

3. The dual drying apparatus as claimed in claim 1, wherein the partition member is made of an incombustible material or a flame retardant material.

4. The dual drying apparatus as claimed in claim 1, wherein a front cabinet of the lower dryer has an upper end that is located higher than the partition member.

5. The dual drying apparatus as claimed in claim 4, wherein the upper dryer comprises a control panel portion arranged on an upper side of the front cabinet of the lower dryer.

6. The dual drying apparatus as claimed in claim 1, wherein the upper dryer comprises:

a drying chamber configured to accommodate an object to be dried;

a frame configured to support the drying chamber; and a reinforcement bracket configured to be coupled to a front of the frame.

7. The dual drying apparatus as claimed in claim 6, wherein the frame comprises:

left and right wall bodies configured to support left and right sides of the drying chamber, respectively; and first and second connection portions configured to connect front portions and rear portions of the left and right wall bodies, respectively, wherein both sides of the reinforcement bracket are screw-fastened to front ends of the left and right wall bodies, respectively.

8. The dual drying apparatus as claimed in claim 1, wherein a coupling location of the upper dryer is guided by a coupling location guide portion when the upper dryer is coupled to the lower dryer.

9. The dual drying apparatus as claimed in claim 8, wherein the coupling location guide portion comprises:

a plurality of setting projections formed on any one of the lower dryer and the upper dryer; and a plurality of insertion holes formed on another one of the lower dryer and the upper dryer so that the plurality of setting projections are respectively inserted therein.

10. The dual drying apparatus as claimed in claim 9, wherein the plurality of setting projections are arranged at predetermined intervals along both end portions of any one of the lower dryer and the upper dryer, and the plurality of insertion holes are arranged at predetermined intervals along both end portions of the other of the lower dryer and the upper dryer.

11. The dual drying apparatus as claimed in claim 10, wherein the lower dryer and the upper dryer are fixed to each other through screw fastening on front and rear surfaces thereof.

12. A dual drying apparatus comprising:

a lower dryer including a rotary drum disposed therein;

an upper dryer separably coupleable to an upper side of the lower dryer, the upper dryer having a height that is lower than a height of the lower dryer; and a curved partition member configured to partition an interior of the lower dryer from an interior of the upper dryer, the curved partition member being shaped to be disposed along an exterior portion of the rotary drum.

13. The dual drying apparatus as claimed in claim 12, wherein the upper dryer is provided with a frame configured to support a drying chamber accommodating therein an object to be dried, and both sides of the frame are fastened to both sides of a reinforcement bracket.

14. The dual drying apparatus as claimed in claim 12, wherein the lower dryer comprises a main cabinet configured to cover left, right, and rear sides thereof, and a front cabinet configured to cover a front surface thereof, wherein an upper end of the front cabinet is located higher than the curved partition member.

* * * * *